US010060421B2

(12) United States Patent
Brown et al.

(10) Patent No.: US 10,060,421 B2
(45) Date of Patent: Aug. 28, 2018

(54) HYDRAULIC DRIVE MULTI-ELEMENT CRYOGENIC PUMP

(71) Applicant: Caterpillar Inc., Peoria, IL (US)

(72) Inventors: Cory A. Brown, Peoria, IL (US); Adrienne M. Brasche, Peoria, IL (US); Sunil J. Bean, Peoria, IL (US); Shivangini S. Hazari, Peoria, IL (US); Sana Mahmood, Peoria, IL (US); Nikhil M. Arya, Washington, IL (US); Joshua W. Steffen, El Paso, IL (US); Daniel R. Baldwin, Peoria, IL (US); Dana R. Coldren, Secor, IL (US); Robert M. Campion, Chillicothe, IL (US); Alan R. Stockner, Metamora, IL (US)

(73) Assignee: Caterpillar Inc., Deerfield, IL (US)

( * ) Notice: Subject to any disclaimer, the term of this patent is extended or adjusted under 35 U.S.C. 154(b) by 420 days.

(21) Appl. No.: 14/753,585

(22) Filed: Jun. 29, 2015

(65) Prior Publication Data

US 2016/0377068 A1 Dec. 29, 2016

(51) Int. Cl.
*F04B 9/117* (2006.01)
*F04B 23/02* (2006.01)
(Continued)

(52) U.S. Cl.
CPC ..... *F04B 23/02* (2013.01); *F04B 23/06* (2013.01); *F04B 37/08* (2013.01); *F04B 49/065* (2013.01);
(Continued)

(58) Field of Classification Search
CPC .... F04B 9/10; F04B 9/1176; F04B 2015/081; F04B 23/021; F04B 49/06; F04B 49/065;
(Continued)

(56) References Cited

U.S. PATENT DOCUMENTS 5,024,584 A 6/1991 Bordini et al.
5,411,374 A * 5/1995 Gram ..... F04B 15/06 141/18
(Continued)

FOREIGN PATENT DOCUMENTS

JP 2012-052425 A 3/2012
JP 5519857 4/2014
WO 2014078962 5/2014

*Primary Examiner* — Charles Freay
*Assistant Examiner* — Thomas Fink
(74) *Attorney, Agent, or Firm* — Leydig, Voit & Mayer, Ltd.

(57) ABSTRACT

A cryogenic fluid pump includes a plurality of pumping elements, each of the plurality of pumping elements having an actuator portion that is associated with and configured to selectively activate one end of a pushrod in response to a command by an electronic controller, an activation portion associated with an opposite end of the pushrod, and a pumping portion associated with the activation portion. For each of the plurality of pumping elements, the pumping portion is activated for pumping a fluid by the activation portion, which activation portion is activated by the actuator portion. The electronic controller is configured to selectively activate each of the plurality of pumping elements such that a flow of fluid from the cryogenic fluid pump results from continuous activations of the plurality of pumping elements at selected dwell times between activations of successive pumping elements.

13 Claims, 7 Drawing Sheets

(51) Int. Cl.
*F04B 23/06* (2006.01)
*F04B 37/08* (2006.01)
*F04B 49/06* (2006.01)
*F04B 15/08* (2006.01)

(52) U.S. Cl.
CPC ..... *F04B 9/1176* (2013.01); *F04B 23/023* (2013.01); *F04B 2015/081* (2013.01); *F17C 2227/0142* (2013.01)

(58) Field of Classification Search
CPC ..... F04B 9/109; F04B 23/02; F04B 23/023; F17C 2227/0185; F17C 2265/066; F17C 2227/0178; F17C 2227/0142
USPC ..... 417/901; 137/625.65; 251/129.16; 62/50.6–50.7
See application file for complete search history.

(56) References Cited

U.S. PATENT DOCUMENTS 5,884,488 A * 3/1999 Gram ..... F04B 15/08 417/901
6,354,088 B1 * 3/2002 Emmer ..... F17C 5/007 141/82
6,364,282 B1 * 4/2002 Ausman ..... F02M 57/025 123/446
7,293,418 B2 11/2007 Noble et al.
7,607,898 B2 * 10/2009 Noble ..... F02M 21/06 417/207
8,513,847 B2 8/2013 Madison
8,671,700 B2 3/2014 Duong et al.
2002/0157402 A1 * 10/2002 Drube ..... F17C 5/007 62/50.1
2008/0302111 A1 * 12/2008 Batenburg ..... F04B 9/105 62/50.6
2010/0180607 A1 * 7/2010 Duong ..... F04B 15/08 62/50.6
2014/0109600 A1 * 4/2014 Lefevre ..... F04B 15/08 62/50.6
2014/0161627 A1 * 6/2014 Sivaramakrishnan .. F04B 1/128 417/2
2014/0172269 A1 6/2014 Perry
2014/0216403 A1 8/2014 Stockner

* cited by examiner

HYDRAULIC DRIVE MULTI-ELEMENT CRYOGENIC PUMP

TECHNICAL FIELD

This patent disclosure relates generally to pumps and, more particularly, to cryogenic fuel pumps for mobile applications.

BACKGROUND

Many large mobile machines such as mining trucks, locomotives, marine applications and the like have recently begun using alternative fuels, alone or in conjunction with traditional fuels, to power their engines. For example, large displacement engines may use a gaseous fuel, alone or in combination with a traditional fuel such as diesel, to operate. Because of their relatively low densities, gaseous fuels, for example, natural gas or petroleum gas, are carried onboard vehicles in liquid form. These liquids, the most common including liquefied natural gas (LNG) or liquefied petroleum gas (LPG), are cryogenically stored in insulated tanks on the vehicles, from where a desired quantity of fuel is pumped, evaporated, and provided to fuel the engine.

The pumps that are typically used to deliver the LNG to the engine of the machine include pistons, which deliver the LNG to the engine. Such piston pumps, which are sometimes also referred to as cryogenic pumps, will often include a single piston that is reciprocally mounted in a cylinder bore. The piston is moved back and forth in the cylinder to draw in and then compress the LNG. Power to move the piston may be provided by different means, the most common being electrical, mechanical or hydraulic power.

One example of a cryogenic pump can be found in U.S. Pat. No. 7,293,418 (the '418 patent), which describes a cryogenic, single-element pump for use in a vehicle. The pump discharges into an accumulator that is located within the tank, and uses a single piston pump that is connected to a drive section via a piston rod. The drive section is disposed outside of the tank.

Pumps such as the pump described in the '418 patent are generally large, heavy and complex, which are due, in part, to the large operating pressures and high volumes of fluid that must be delivered to operate a large displacement engine. Because of the nature of their operation, in that a quantity of fluid is delivered by each stroke, typical systems also require various pressure accumulators and regulators to smooth the supply of gaseous fuel to the engine, which further burdens the vehicles with additional components, cost and complexity.

SUMMARY

The present disclosure is generally directed to a hydraulically driven cryogenic pump comprising multiple plunging pumping elements. The cryogenic pump may be disposed at least partially within an LNG tank. The disclosed systems and method are generally more cost effective than previously proposed system, in that they may be configured without the need to use accumulators, regulators and boost pumps. This, and other aspects, allow an overall reduction of the gas delivery system's size, weight and complexity, and also durability.

The disclosure, therefore, describes, in one aspect, a cryogenic pump. The cryogenic pump includes a plurality of pumping elements, each of which has an actuator portion that is associated with, and configured to, selectively activate one end of a pushrod in response to a command by an electronic controller. Each pumping element further includes an activation portion associated with an opposite end of the pushrod, and a pumping portion associated with the activation portion. For each of the plurality of pumping elements, the pumping portion is activated for pumping a fluid by the activation portion, which activation portion is activated by the actuator portion. The electronic controller is configured to selectively activate each of the plurality of pumping elements such that a flow of fluid from the cryogenic fluid pump results from successive activations of the plurality of pumping elements at selected dwell times between activations.

In another aspect, the disclosure describes a method for operating a cryogenic pump having a plurality of pumping elements included therewith, each of the plurality of pumping elements being responsive to a corresponding pumping command from an electronic controller. The method includes determining, in the electronic controller, a desired flow rate for fluid pumped by the cryogenic pump, and also determining, in the electronic controller, a frequency and dwell time of pumping element activations based on the desired flow rate. The method further includes commanding with the electronic controller each of the plurality of pumping elements to perform a corresponding pumping stroke, such that an aggregate of the fluid pumped by each of the corresponding pumping strokes approaches the desired flow rate.

In yet another aspect, the disclosure describes a pumping system for providing a cryogenic fluid for use as a fuel for an engine. The pumping system includes an electronic controller, a hydraulic pump operably associated with the electronic controller, wherein operation of the hydraulic pump is responsive to pump commands from the electronic controller, and a cryogenic pump having a plurality of pumping elements. Each of the plurality of pumping elements includes an actuator portion that is associated with and configured to selectively activate one end of a pushrod in response to a command by the electronic controller. The actuator portion is powered by hydraulic fluid provided at a pressure by the hydraulic pump. Each of the plurality of pumping elements further includes an activation portion associated with an opposite end of the pushrod, and a pumping portion associated with the activation portion. For each of the plurality of pumping elements, the pumping portion is activated for pumping a fluid by the activation portion, which activation portion is activated by the actuator portion. The electronic controller is configured to selectively activate each of the plurality of pumping elements such that a flow of fluid from the cryogenic fluid pump results from continuous activations of the plurality of pumping elements at selected dwell times between activations of successive pumping elements.

DETAILED DESCRIPTION

Figure 1:
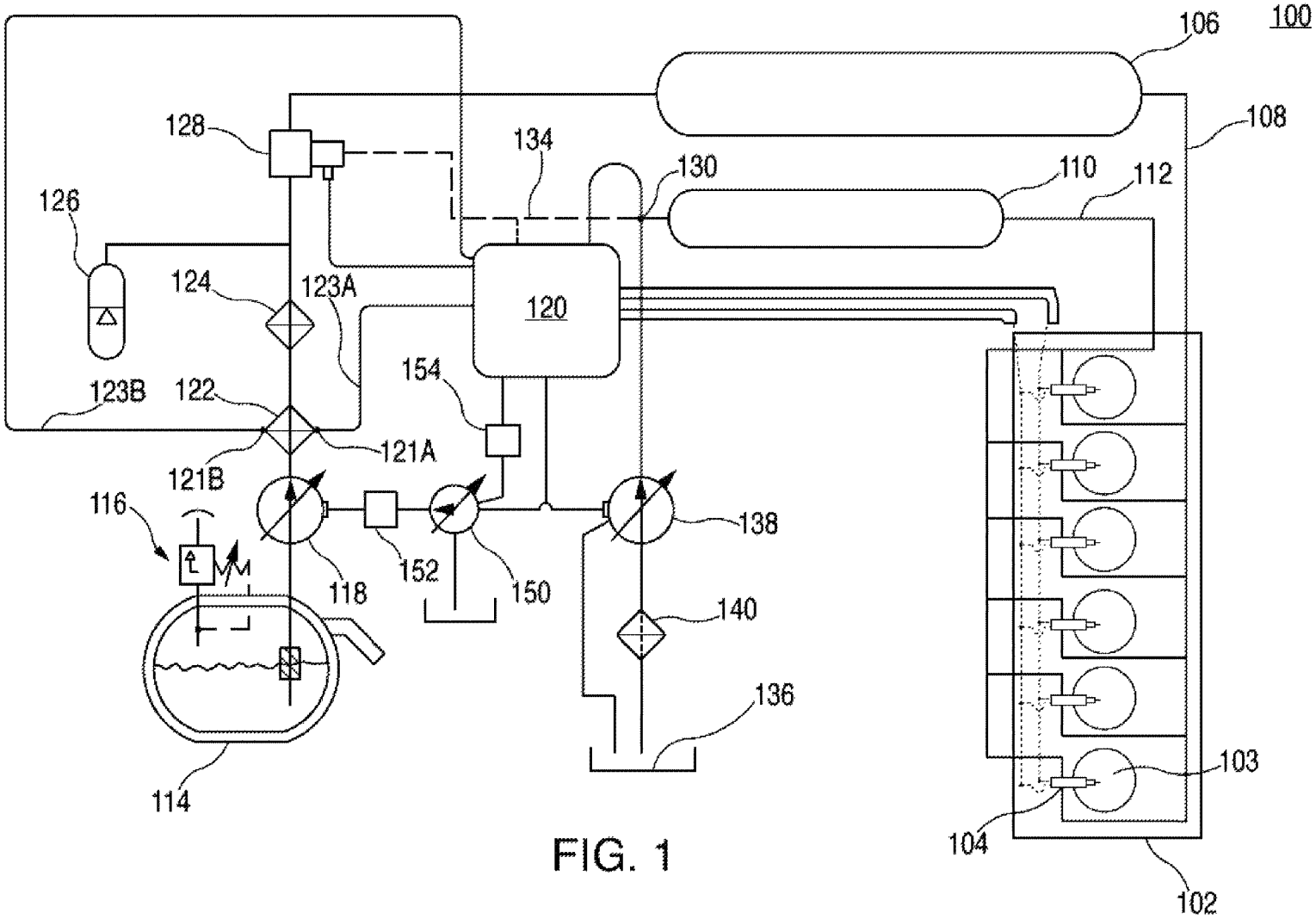
FIG. 1 is a schematic diagram of an engine system having a compressed gas fuel system that includes a gaseous fuel storage tank and corresponding fuel pump in accordance with the disclosure.

This disclosure relates to engines using a gaseous fuel source such as direct injection gas (DIG) or indirect injection gas engines using diesel or spark ignition. More particularly, the disclosure relates to an embodiment for an engine system that includes a gaseous fuel storage tank having a pump that supplies cryogenically stored fluid to fuel an engine. A schematic diagram of a DIG, engine system 100, which in the illustrated embodiment uses diesel as the ignition source, is shown in FIG. 1, but it should be appreciated that indirect injection engines, and/or engines using a different ignition mode are contemplated. The engine system 100 includes an engine 102 (shown generically in FIG. 1) having a fuel injector 104 associated with each engine cylinder 103. The fuel injector 104 can be a dual-check injector configured to independently inject predetermined amounts of two separate fuels, in this case, diesel and gas, into the engine cylinders.

The fuel injector 104 is connected to a high-pressure gaseous fuel rail 106 via a high-pressure gaseous fuel supply line 108 and to a high-pressure liquid fuel rail 110 via a liquid fuel supply line 112. In the illustrated embodiment, the gaseous fuel is natural or petroleum gas that is provided through the high-pressure gaseous fuel supply line 108 at a pressure of between about 10-50 MPa, and the liquid fuel is diesel, which is maintained within the high-pressure liquid fuel rail 110 at about 15-100 MPa, but any other pressures or types of fuels may be used depending on the operating conditions of each engine application. It is noted that although reference is made to the fuels present in the high-pressure gaseous fuel supply line 108 and the high-pressure liquid fuel rail 110 using the words "gaseous" or "liquid," these designations are not intended to limit the phase in which is fuel is present in the respective rail and are rather used solely for the sake of discussion of the illustrated embodiment. For example, the fuel provided at a controlled pressure within the high-pressure gaseous fuel supply line 108, depending on the pressure at which it is maintained, may be in a liquid, gaseous or supercritical phase. Additionally, the liquid fuel can be any hydrocarbon based fuel; for example DME (Di-methyl Ether), biofuel, MDO (Marine Diesel Oil), or HFO (Heavy Fuel Oil).

Whether the engine system 100 is installed in a mobile or a stationary application, each of which is contemplated, the gaseous fuel may be stored in a liquid state in a tank 114, which can be a cryogenic storage tank that is pressurized at a relatively low pressure, for example, atmospheric, or at a higher pressure. In the illustrated embodiment, the tank 114 is insulated to store liquefied natural gas (LNG) at a temperature of about −160° C. (−256° F.) and a pressure that is between about 100 and 1750 kPa, but other storage conditions may be used. The tank 114 further includes a pressure relief valve 116. In the description that follows, a DIG engine system embodiment is used for illustration, but it should be appreciated that the systems and methods disclosed herein are applicable to any machine, vehicle or application that uses cryogenically stored gas, for example, a locomotive in which the tank 114 may be carried in a tender car.

Relative to the particular embodiment illustrated, during operation, LNG from the tank is pressurized, still in a liquid phase, in a pump 118, which raises the pressure of the LNG while maintaining the LNG in a liquid phase. The pump 118 is configured to selectively increase the pressure of the LNG to a pressure that can vary in response to a pressure command signal provided to the pump 118 from an electronic controller 120. The pump 118 is shown external to the tank 114 in FIG. 1 for illustration, but it is contemplated that the pump 118 may at least partially be disposed within the tank 114, as is illustrated in the figures that follow, for example, in FIG. 2. Although the LNG is present in a liquid state in the tank, the present disclosure will make reference to compressed or pressurized LNG for simplicity when referring to LNG that is present at a pressure that exceeds atmospheric pressure.

The pressurized LNG provided by the pump 118 is heated in a heat exchanger 122. The heat exchanger 122 provides heat to the compressed LNG to reduce density and viscosity while increasing its enthalpy and temperature. In one exemplary application, the LNG may enter the heat exchanger 122 at a temperature of about −160° C., a density of about 430 kg/m$^3$, an enthalpy of about 70 kJ/kg, and a viscosity of about 169 μPa s as a liquid, and exit the heat exchanger at a temperature of about 50° C., a density of about 220 kg/m$^3$, an enthalpy of about 760 kJ/kg, and a viscosity of about 28 μPa s. It should be appreciated that the values of such representative state parameters may be different depending on the particular composition of the fuel being used. In general, the fuel is expected to enter the heat exchanger in a cryogenic, liquid state, and exit the heat exchanger in a supercritical gas state, which is used herein to describe a state in which the fuel is gaseous but has a density that is between that of its vapor and liquid phases.

The heat exchanger 122 may be any known type of heat exchanger or heater for use with LNG. In the illustrated embodiment, the heat exchanger 122 is a jacket water heater that extracts heat from engine coolant. In alternative embodiments, the heat exchanger 122 may be embodied as an active heater, for example, a fuel fired or electrical heater, or may alternatively be a heat exchanger using a different heat source, such as heat recovered from exhaust gases of the engine 102, a different engine belonging to the same system such as what is commonly the case in locomotives, waste heat from an industrial process, and other types of heaters or heat exchangers. In the embodiment shown in FIG. 1, which uses engine coolant as the heat source for the heat exchanger 122, a pair of temperature sensors 121A and 121B are disposed to measure the temperature of engine coolant entering and exiting the heat exchanger 122 and provide corresponding temperature signals 123 to the electronic controller 120.

Liquid fuel, or in the illustrated embodiment diesel fuel, is stored in a fuel reservoir 136. From there, fuel is drawn into a fuel pump 138 through a filter 140. The fuel pump 138 may have a variable flow capability to provide fuel to the engine at a variable rate depending on the operating mode of the engine. The rate of fuel provided by the fuel pump 138 can be controlled in response to a command signal from the electronic controller 120. Pressurized fuel from the fuel pump 138 is provided to the high-pressure liquid fuel rail 110. Similarly, the pump 118 has a variable supply capability that is responsive to a signal from the electronic controller 120.

Contaminants may be removed from the gas exiting the heat exchanger 122 by a filter 124. As can be appreciated, the gas passing through the filter 124 may include gas present in more than one phase such as gas or liquid. An optional gas accumulator 126 may collect filtered gas upstream of a pressure regulator 128 that can selectively control the pressure of gas provided to the high-pressure gaseous fuel rail 106 that is connected to the high-pressure gaseous fuel supply line 108. To operate the pump 118, a hydraulic pump 150 having a variable displacement and selectively providing pressurized hydraulic fluid to the pump 118 via a valve system 152 is used. Operation of the hydraulic pump 150 is controlled by an actuator 154 that responds to commands from the electronic controller 120. The valve system 152 also operates in response to commands from the controller 120.

Figure 2:
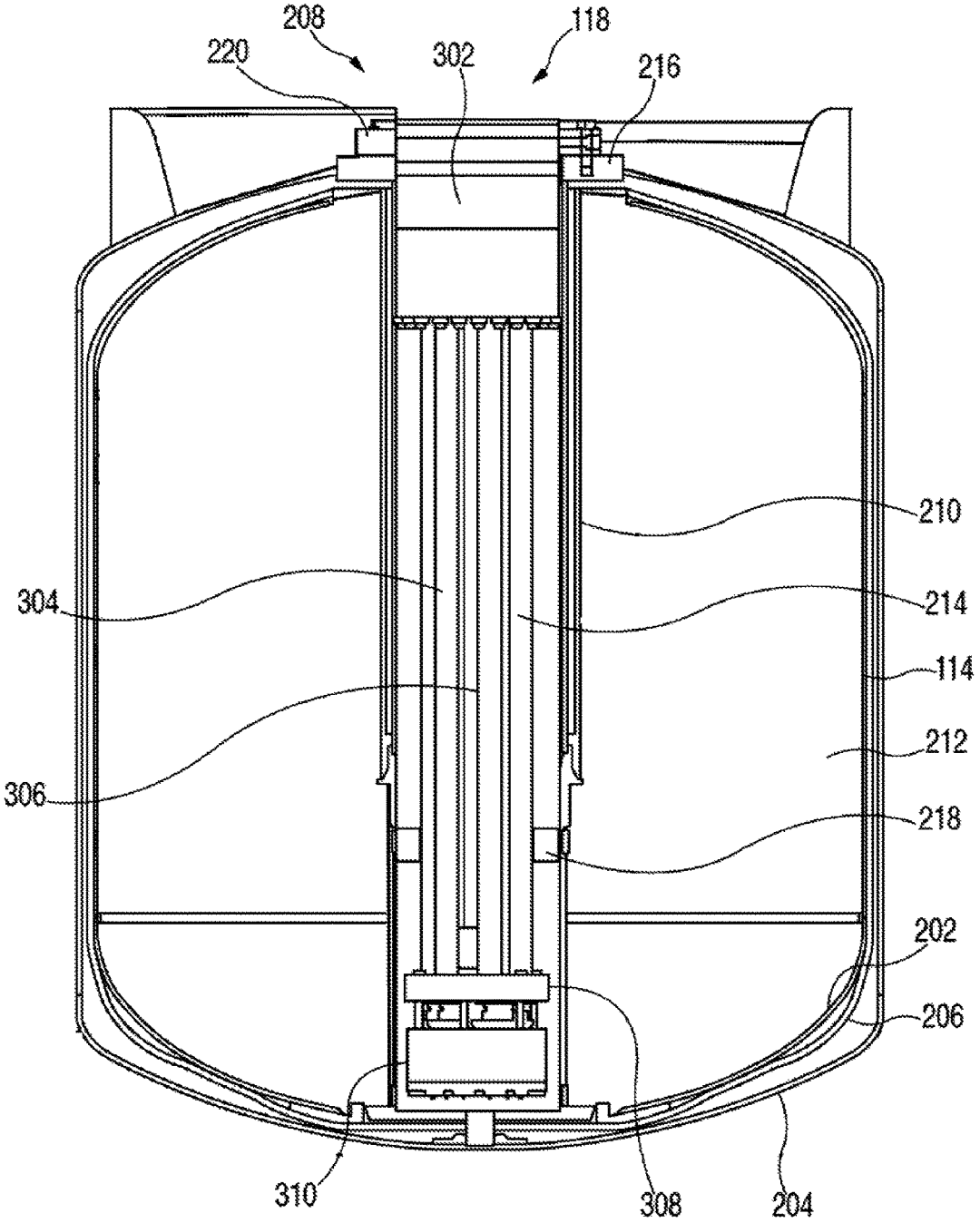
FIG. 2 is a section view of a cryogenic pump in accordance with the disclosure installed into a cryogenic fluid storage tank.

A section view of the tank 114 having the pump 118 at least partially disposed therein is shown in FIG. 2. The tank 114 may include an inner wall 202, which defines a chamber 212 containing the pressurized LNG, and an outer wall 204. A layer of insulation 206 may optionally be used, and/or a vacuum may be created along a gap between the inner wall 202 and the outer wall 204. Both the inner wall 202 and the outer wall 204 have a common opening 208 at one end of the tank, which surrounds a cylindrical casing 210 that extends into a tank interior 212. The cylindrical casing 210 is hollow and defines a pump socket 214 therein that extends from a mounting flange 216 into the tank chamber 212 and accommodates the pump 118 therein. A seal 218 separates the interior of a portion of the pump socket 214 from the tank chamber 212.

Figure 3:
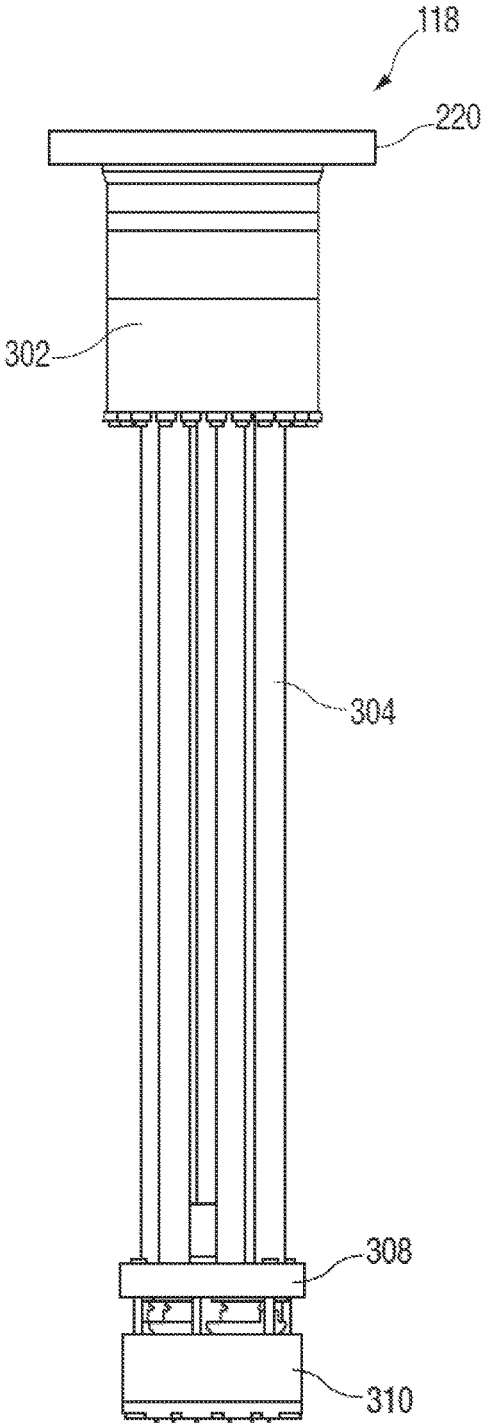
FIG. 3 is an outline view.

The pump 118 in the illustrated embodiment has a generally cylindrical shape and includes a pump flange 220 that supports the pump 118 on the mounting flange 216 of the tank 114. An outline view of the pump 118, removed from the tank 114, is also shown in FIG. 3, and is partially sectioned to expose internal components in FIG. 4. The pump 118 generally includes an actuator portion 302 that operates to selectively activate one or more pushrods 304. The pushrods 304 surround a compression tube 306, which may optionally also operate as an outlet passage for the pump 118. The pushrods 304, which are caused to reciprocate during operation by the actuator portion 302, extend from the actuator portion 302 to an activation portion 308 that is associated with a pumping portion 310. During operation, the pumping portion 310, which may be immersed in cryogenic fluid, operates to pump fluid from the tank interior 212 out of the tank and through an outlet or, in some embodiments, the compression tube 306 to supply the engine with fuel, as previously described. The pumping portion 310 is activated for pumping fluid by the activation portion 308, which in turn translates the reciprocal motion of the pushrods 304 into a pumping action that operates the pumping portion 310. The transmission of the reciprocal motion of the pushrods 304 can be accomplished by any appropriate structures or method including via a solid structure or by another method such as a closed hydraulic or pneumatic volume that can transmit a displacement.

Figure 4:
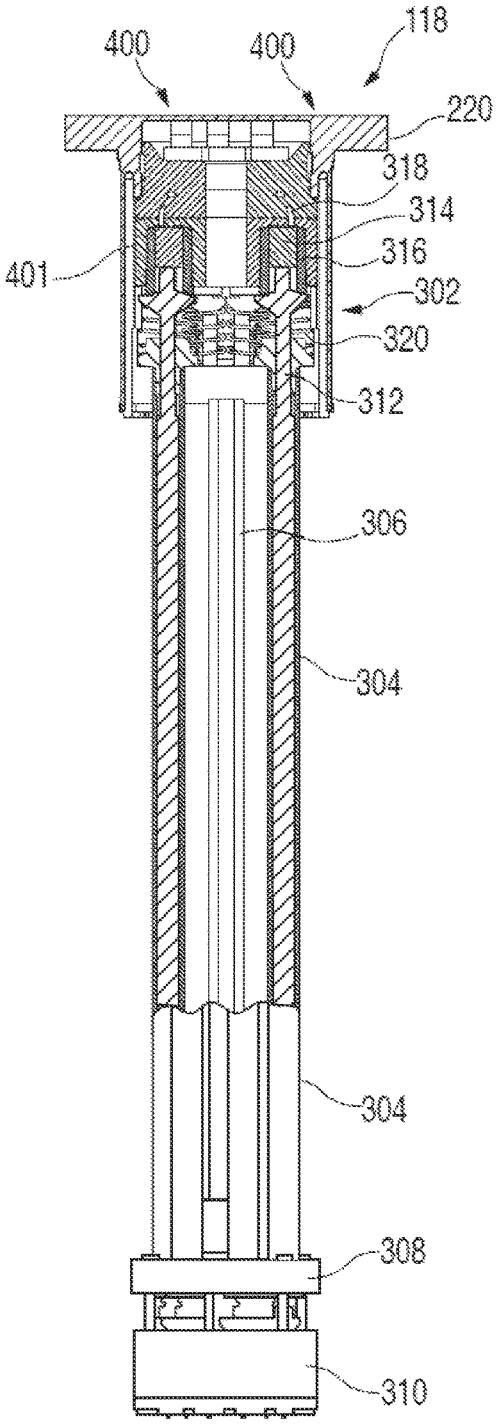
FIG. 4 is a fragmented view of a multi-element pump in accordance with the disclosure.
Figure 8:
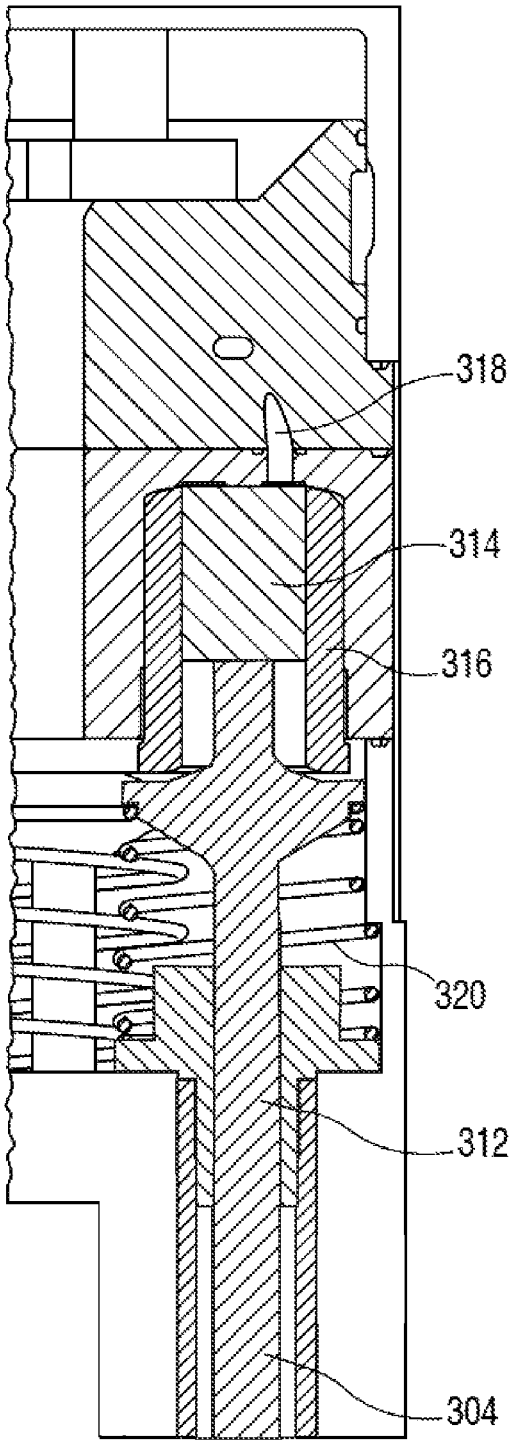
FIG. 8 is a hydraulic tappet and pushrod assembly in accordance with the disclosure.

In the illustrated embodiment, the pushrods 304, shown in cross section in FIG. 4 and also shown in enlarged detail in FIG. 8, are downwards, in the orientation of the pump shown in FIG. 4, by a tappet 314 operating in a bore 316 by hydraulic fluid provided under pressure behind the tappet 314 through an activation passage 318. A return spring 320 returns the pushrod 304 via an upper pushrod portion 312, and thus the tappet 314, when pressurization of the hydraulic fluid behind the tappet is removed or, stated differently, when the space behind the tappet 314 is vented.

Figure 6:
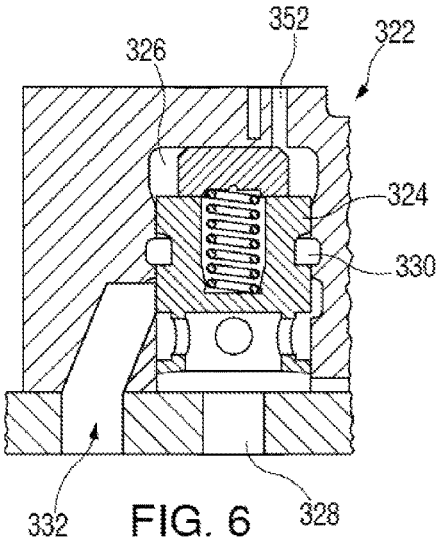
FIGS. 6 and 7 are section views of a spool valve in accordance with the disclosure in two operating positions.
Figure 7:
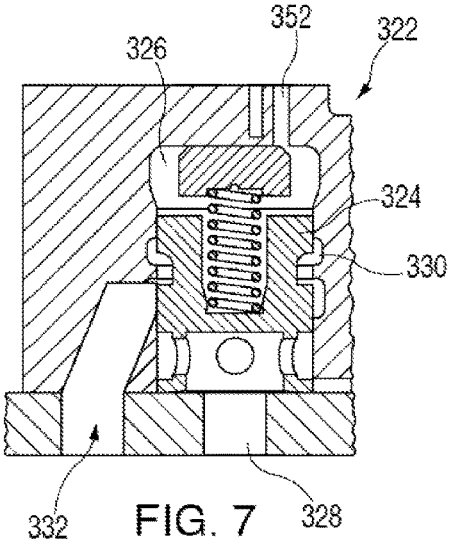

The pressurized hydraulic fluid to activate the tappet 314 is provided in the space behind the tappet, and is also vented, by the selective positioning of a spool valve 322, which is shown in two operating positions in FIGS. 6, and 7. In FIG. 6, the spool valve 322 is shown in a fill position, which fills the space behind the tappet 314 with high pressure oil to cause the tappet to extend, and in FIG. 7 the spool valve is shown in a drain position, which vents the space behind the tappet 314 to permit the tappet 314 to return by force of the return spring 320 (FIG. 8), and thus retract.

The spool valve 322 in the illustrated embodiment includes a spool valve element 324 that is reciprocally mounted and operates within a bore 326. The bore 326, which accommodates the spool valve element 324, is fluidly connected to a fluid supply passage 328, which supplies pressurized fluid to move the tappet 314. For example, as shown in FIG. 1, the pressurized fluid can be hydraulic fluid supplied by a hydraulic pump like the hydraulic pump 150. The flow rate and pressure of the hydraulic fluid can be controlled, for example, by the valve system 152 also shown in FIG. 1, in response to control commands from the electronic controller 120 (FIG. 1).

The bore 326 is also fluidly connected to a vent passage 330 (partially shown in FIGS. 6 and 7), which is open to a fluid reservoir in the known fashion for venting pressurized fluid. A tappet supply passage 332 fluidly connects the bore 326 to the area behind the tappet 314, which in the embodiment shown in FIG. 8 means that the tappet supply passage 332 is fluidly open to the activation passage 318. During operation, when the spool valve element 324 is disposed at the fill position shown in FIG. 6, the spool valve element 324 fluid supply passage 328 is placed in fluid communication with the tappet supply passage 332 and the vent passage 330 is fluidly isolated from the tappet supply passage 332. In this operating position, fluid from the fluid supply passage 328 at a high pressure is routed into the tappet supply passage 332, which in turn provides the fluid to the activation passage 318 from where the fluid, by hydraulic pressure, pushes the tappet 314 that extends the pushrod 304 to activate a pumping element at the other end of the pump 118, as previously described. At the venting position, as shown in FIG. 7, the spool valve element moves to fluidly block the fluid supply passage 328 and in turn fluidly connect the tappet supply passage 332 with the vent passage 330. In this operating position, fluid flows out from behind the tappet 314, through the activation passage 318 and the tappet supply passage 332 and into the vent passage 330, from where it is vented. These motions are facilitated by the return spring 320 that pushes the upper pushrod portion 312, and thus the tappet 314, to retract.

Figure 5:
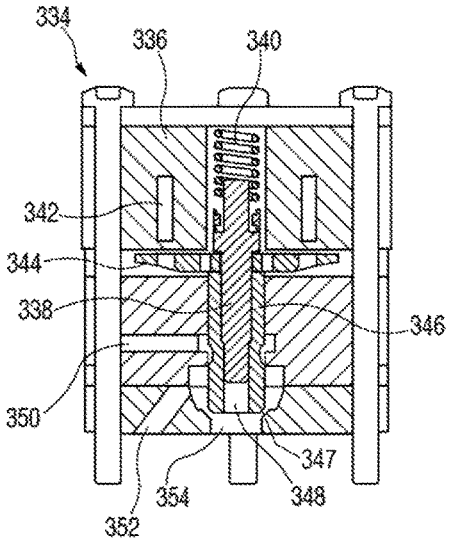
FIG. 5 is a section view of a unit hydraulic actuator in accordance with the disclosure.

In the illustrated embodiment, the spool valve element 324 at an energized condition is disposed in the fill position (FIG. 6) and, when de-energized, assumes the drain position (FIG. 7). Activation of the spool valve element 324 requires a displacement of the same along an axis along which the spool valve element 324 reciprocates. The displacement is provided by an actuator 334, which is shown in section view in FIG. 5. The actuator 334 is an electromechanical pilot actuator, but other actuator types such as actuators using piezoelectric elements can be used. The actuator 334 includes a solenoid 336 that, when energized, retracts a pin 338 that is reciprocally disposed at least partially in the solenoid 336 and includes a return spring 340. In the illustrated embodiment, the pin 338 is a fastener. The spool may include a ferric core 342. The pin 338 includes an armature 344 and reciprocates within a pin guide 346 forming a hollow bore 348. The hollow bore 348 is fluidly isolated from a hydraulic oil supply passage 350, a spool valve supply outlet 352, and a drain outlet 354. The hydraulic oil supply passage 350 may be connected directly or through the valve system 152 with an outlet of the hydraulic pump 150 (FIG. 1). The pin guide 346 forms two poppet valve seat that, depending on the activation state of the solenoid 336, fluidly connect or isolate the various fluid passages.

More specifically, during operation, depending on the activation state of the solenoid 336, the position of the pin 338 within the pin guide 346 operates between an activation position and a drain position. In the activation position, a lower seat valve 347 opens as the armature 344 moves upward, which places the spool valve supply outlet 352 in fluid communication with the drain outlet 354, which, as shown in FIGS. 6 and 7, is connected to the interior of the bore 326 and pressurizes the area below the spool valve element 324, causing the same to move upwards by hydraulic force within the bore from the drain position (FIG. 7) to the fill position (FIG. 6), and thus activate the tappet 314 (FIG. 8) as previously described by supplying pressurized fluid to the activation passage 318 through the tappet supply passage 332. Thus, when the pin 338 is in the activated position, the spool valve element 324 is in the fill position. Similarly, when the pin 338 is deactivated, or in a drain position, the spool valve supply outlet 352 is placed in fluid communication with the hydraulic oil supply passage 350, which drains the fluid below the spool valve element 324, causing it to extend in the bore 326 and thus vent the activation passage 318 (FIG. 8). Thus, when the pin 338 is in the deactivated, the spool valve element 324 is in the drain position (FIG. 7). The fluid supply passage 328 may be directly connected to an outlet of the hydraulic pump 150, or may alternatively be connected to the outlet of the hydraulic pump 150 via the valve system 152. In the illustrated embodiment, the fluid supply passage 328 is at all times fluidly connected with the hydraulic oil supply passage 350, but the two passages may be separated at times or operate at different pressures depending on the operating condition of the pump 118 and/or the hydraulic pump 150.

Operation of the actuator 334 depends on the presence of electrical power in the spool 336, which is selectively provided by the electronic controller 120 (FIG. 1) such that the selective pumping action of the pump 118 can be selectively carried out. The pump 118 advantageously includes six, separately activatable, pumping elements 400 (two shown in cross section), but another number of pumping elements can be used, for example, one, two, three, four, five, or more than six, depending on the application of the pump to a particular system. In reference to FIG. 4, where a cross section of the pump 118 that is taken along a place extending diametrically across the general cylindrical shape of the pump 118, it can be seen that the six pumping elements, each with its own set of components as described and shown in FIGS. 5-8, are disposed in diametrically opposed pairs symmetrically around the pump. An odd number of pumping elements disposed at regular angular intervals around the pump can also be used. The tappets are housed in a tappet housing 401 that forms bores symmetrically around the pump and supports or otherwise accommodates the various other components of the pump 118. The electronic controller 120 is configured and programmed to selectively activate each pumping element by sending and appropriate command, at a desired time and for a desired duration, to each of the actuators 334 of the respective pumping elements 400.

INDUSTRIAL APPLICABILITY

The present disclosure is applicable to any type of application that involves a liquefied gas storage tank. In the illustrated embodiment, a machine having a CNG or LPG fuel source that is carried in an on-board tank was used for illustration, but those of ordinary skill in the art should appreciate that the methods and systems described herein have universal applicability to any type of compressed gas tank that includes a pump for pumping liquefied gas from the tank to supply a system such as an engine with gas.

Figure 9:
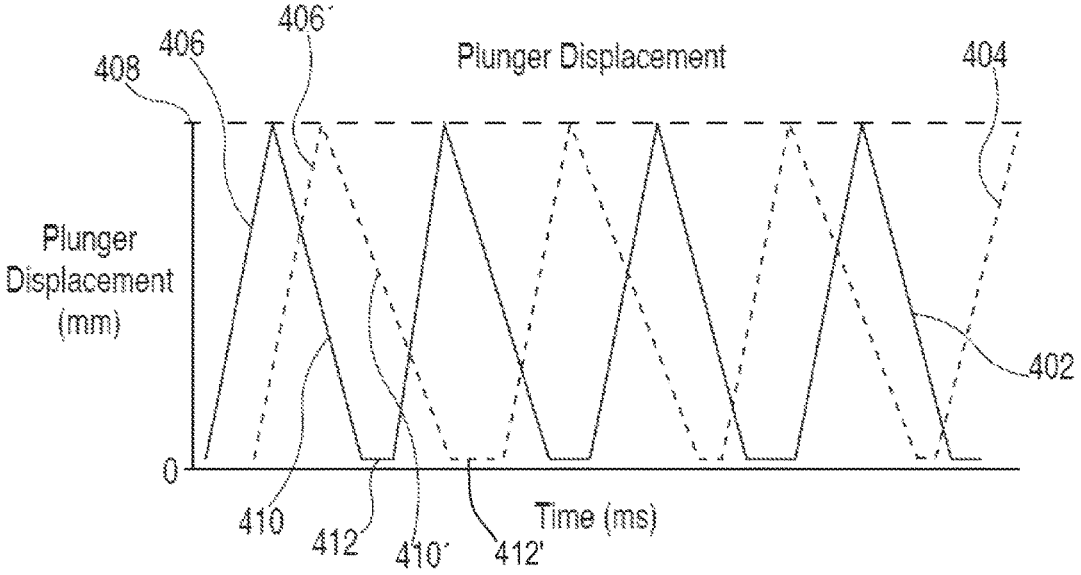
FIGS. 9 and 10 are graphs showing pump operating parameters in accordance with the disclosure.
Figure 10:
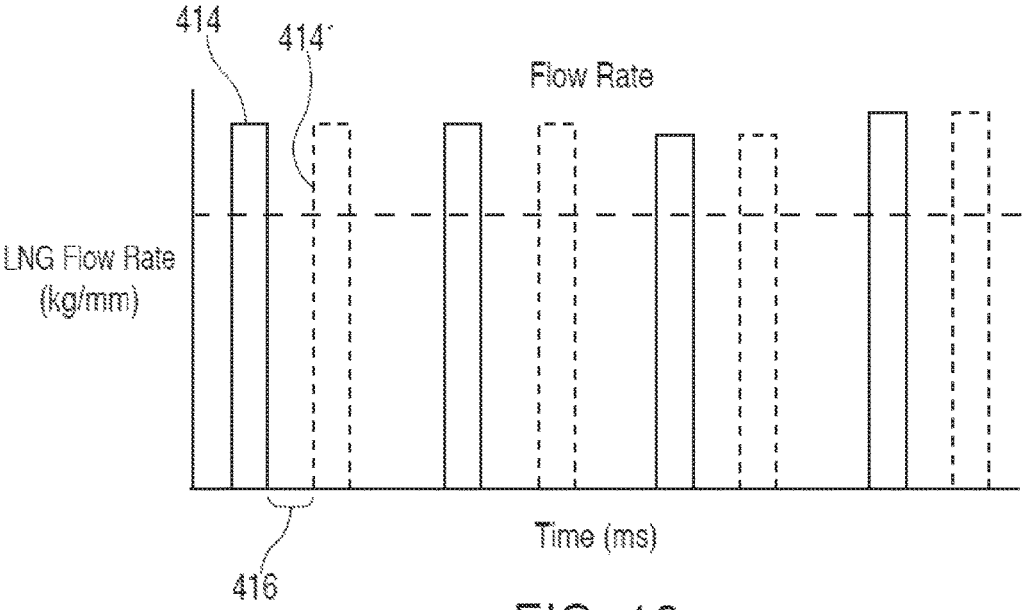

Two charts that illustrate displacement and supplied liquid flow in a multi-element pump in accordance with the disclosure are shown in FIGS. 9 and 10. In FIG. 9, a graph showing displacement of, for example, the tappet 314 (FIG. 8), or plunger displacement for a pumping element, whose motion is plotted along the vertical axis with respect to time, the time being plotted along the horizontal axis. Two curves 402 and 404 are shown, each representing the motion of a respective one of multiple pumping elements such as the pumping elements 400 (FIG. 4). Shown in solid line, the first curve 402 includes a generally linear rise 406 from a zero position to the maximum piston or plunger stroke distance 408. The extended tappet or plunger then follows the first curve along a generally linear drop 410 in displacement from the maximum, plunger stroke distance 408 back to zero. Depending on the flow requirements of the pump, the tappet may be extended again immediately upon its return to zero, along a generally linear increase, which may be at a different slope than the liner drop, which indicates that the plunger extension and retraction or, stated differently, the fill and pumping strokes of the pump, can be selectively carried out at different speeds. If a pumping element is not immediately activated or energized, it may dwell at zero for a dwell time 412. Similarly, the second curve 404 illustrates a linear rise 406', a linear drop 410', and a second dwell 412'.

In the illustrated embodiment, the extending speed shown is about 1.25 m/s, while the retracting speed is at about 0.25 m/s, as an exemplary set of operating parameters by which the fill and pumping strokes are carried out at different plunger speeds. These speeds, while they affect the rate at which the liquefied gas is provided to the engine, are also contributing factors to the ability of the pumping elements to seal the pumping volumes for efficient pumping operation, especially for sealing the sliding interface between pump plungers and their respective bores. Moreover, the relatively slower fill strokes promotes efficient fluid retraction into the pumping volume that encloses the pumping plunger.

The pumped, liquefied gas flows resulting from the plunger or tappet displacements shown in FIG. 9 are plotted in FIG. 10, where flow rate extends along the vertical axis and time extends along the horizontal axis in alignment with the time scale of FIG. 9. As can be seen from the graph, a generally square-wave shaped curve 414, which results from motion of the first pumping element of FIG. 9, occurs during the rise 406 of the first tappet or plunger. A second curve 414' occurs during the rise 406' of the second tappet or plunger. A delay 416 between the two flows 414 and 414' depends on the demands of the system and on the number of elements of the pump.

The delay 416 may be selectively set based on various parameters. For example, the dwell time 412 and the second dwell 412' can contribute to the delay and can be dynamically varied to adjust the delay in real time. For example, for an engine system in which the flows 414 and 414' represent a fuel supply to the engine, operation at idle or at low load, which requires a low fuelling rate, the delay can be adjusted to ensure that no extra fuel is being pumped to the engine. By the same token, a reduction or elimination in the dwell time 412 can decrease the delay 416. To provide the maximum flow capability, the pump can be designed to have any number of pumping elements, and the stroke length and speed of activation can be selected such that the square waves are adjacent one another providing a zero delay, if desired. It should be appreciated that the pumping elements, because they can be activated independently, can be activated in an overlapping or simultaneous fashion by the controller to further increase the flow rate provided and minimize pressure fluctuations to the engine (i.e., to yield a negative delay 416).

Figure 11:
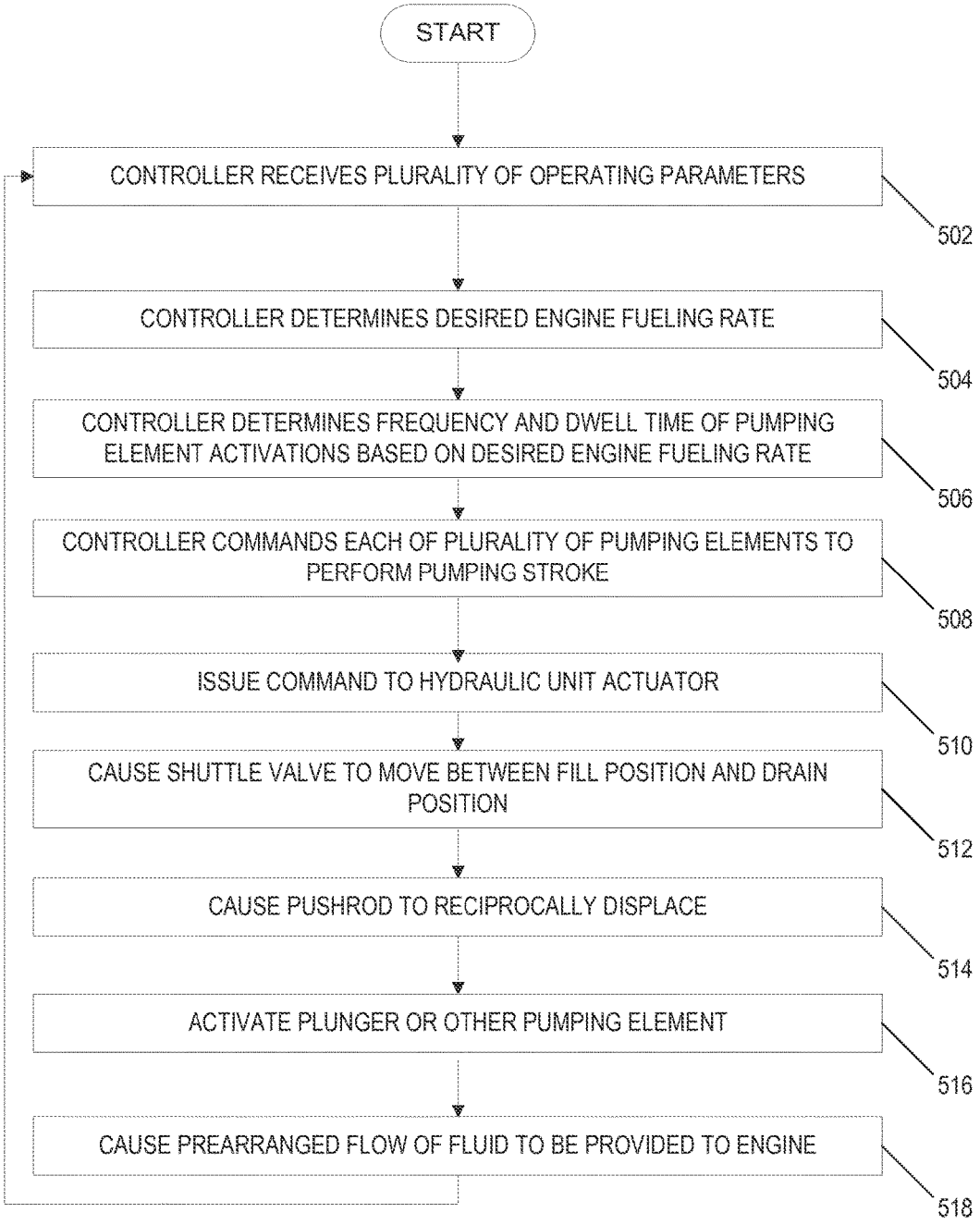
FIG. 11 is a flowchart for a method of operating a multi-element pump in accordance with the disclosure.

A flowchart for a method of operating a multi-element pump in accordance with the disclosure is shown in FIG. 11. In accordance with the method, in which a plurality of pumping elements, each of which is responsive to a respective activation signal from a controller, the controller receives a plurality of engine operating parameters at 502. The controller, based on the engine operating parameters, which may include information sufficient to determine a desired rate of engine fuelling and may include information or signals indicative of engine speed, engine load, and the like, determines a desired engine fueling rate at 504. The desired fueling rate may be embodied as any number of parameters in the controller, including a desired gas pressure in a gas accumulator or a gas manifold associated with the engine. In any event, the desired fueling rate drives the frequency of activation of the pumping elements. Based on the number of pumping elements in the pump, and the flow capacity of each pumping element, and also based on the desired fuel rate, the controller may determine a frequency or, similarly, a dwell time or delay between activations of the various pumping elements at 506. Depending on its determination, the controller may command each of the plurality of pumping elements to perform a pumping stroke at 508.

In one embodiment, each pumping stroke may include issuing a command to a hydraulic unit actuator to activate at 510. Activation of the unit actuator may cause a spool valve element to move between a fill position and a vent position at 512, which causes a pushrod to reciprocally displace at 514 and thus activate a plunger or other pumping element at 516 that causes a prearranged flow of fluid to be provided to the engine at 518. The process is repeated during engine operation with changes, as appropriate, to the frequency and dwell time between activations such that a desired flow rate of fluid to the engine is maintained during engine operation. Apart from controlling frequency and duration of pumping element activations, the controller may also control a duration of activation of a pump element such that a shorter pumping stroke may be carried out in the event less than a full stroke of pumped fluid is desired, which is accomplished by a partial plunger displacement.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A cryogenic fluid pump, comprising:

a plurality of pumping elements, each of the plurality of pumping elements comprising:

an actuator portion that is associated with and configured to selectively activate one end of a pushrod in response to a command by an electronic controller;

an activation portion associated with an opposite end of the pushrod; and a pumping portion associated with the activation portion;

wherein, for each of the plurality of pumping elements, the pumping portion is activated for pumping a fluid by the activation portion;

wherein the activation portion is activated by the actuator portion;

wherein the electronic controller is configured to selectively activate each of the plurality of pumping elements such that a flow of fluid from the cryogenic fluid pump results from successive activations of the plurality of pumping elements at selected dwell times between activations;

wherein the cryogenic fluid pump includes a plurality of actuator portions, one of the plurality of actuator portions for each pumping element, and wherein each of the plurality of actuator portions comprises an electromechanical actuator having a pin associated therewith, the pin arranged in a bore having a hydraulic oil supply passage, a spool valve supply outlet, and a drain outlet, wherein the pin is moveable between a deactivation position, in which the hydraulic oil supply passage is fluidly connected with the spool valve supply outlet, and an activation position, in which the spool valve supply outlet is fluidly connected with the drain outlet; and wherein each of the plurality of actuator portions further comprises a spool valve, the spool valve including a spool valve element reciprocally disposed in a bore, the bore being fluidly connectable with a fluid supply passage, a drain passage, and a tappet supply passage, wherein the spool valve element is moveable between a fill position, in which the fluid supply passage is fluidly connected with the tappet supply passage, and a drain position, in which the tappet supply passage is fluidly connected with the drain passage.

2. The cryogenic fluid pump of claim 1, wherein a plurality of pushrods extends between the actuator portion and the activation portion.

3. The cryogenic fluid pump of claim 1, wherein, during operation, the actuator portion is connected onto a tank such that the activation portion and the pumping portion extend into an interior of the tank, wherein the pumping portion is arranged to be immersed into a cryogenic fluid contained within the interior of the tank.

4. The cryogenic fluid pump of claim 1, wherein the spool valve supply outlet is fluidly connected with the bore into which the spool valve element is disposed, wherein presence of pressurized fluid at the spool valve supply outlet pressurizes the bore behind the spool valve element causing the spool valve element to move from the fill position to the drain position.

5. The cryogenic fluid pump of claim 1, wherein the hydraulic oil supply passage and the fluid supply passage are fluidly connected at all times.

6. The cryogenic fluid pump of claim 1, wherein each of the plurality of actuator portions further comprises:

a tappet disposed in a tappet bore, the tappet bore formed in a tappet housing and being fluidly connected with an activation passage formed in the tappet housing, the activation passage being fluidly connected with the tappet supply passage;

wherein the pushrod is disposed in abutting relation with an end of the tappet that is opposite the activation passage; and a return spring disposed to bias an upper pushrod portion towards the tappet.

7. A pumping system for providing a cryogenic fluid for use as a fuel for an engine, comprising:

an electronic controller;

a hydraulic pump operably associated with the electronic controller, wherein operation of the hydraulic pump is responsive to pump commands from the electronic controller;

a cryogenic pump having a plurality of pumping elements, each of the plurality of pumping elements comprising:

an actuator portion that is associated with and configured to selectively activate one end of a pushrod in response to a command by the electronic controller, wherein the actuator portion is powered by hydraulic fluid provided at a pressure by the hydraulic pump;

an activation portion associated with an opposite end of the pushrod; and a pumping portion associated with the activation portion;

wherein, for each of the plurality of pumping elements, the pumping portion is activated for pumping a fluid by the activation portion, wherein the activation portion is activated by the actuator portion;

wherein the electronic controller is configured to selectively activate each of the plurality of pumping elements such that a flow of fluid from the cryogenic fluid pump results from continuous activations of the plurality of pumping elements at selected dwell times between activations of successive pumping elements;

wherein the cryogenic pump includes a plurality of actuator portions, one of the plurality of actuator portions corresponding to each pumping element, and wherein each of the plurality of actuator portions comprises an electromechanical actuator having a pin associated therewith, the pin arranged in a bore having a hydraulic oil supply passage, which is arranged to receive pressurized hydraulic fluid from the hydraulic pump, a spool valve supply outlet, and a drain outlet, wherein the pin is moveable between an activation position, in which the hydraulic oil supply passage if fluidly connected with the spool valve supply outlet, and a drain position, in which the spool valve supply outlet is fluidly connected with the drain outlet and wherein each of the plurality of actuator portions further comprises a spool valve, the spool valve including a spool valve element reciprocally disposed in a bore, the bore being fluidly connectable with a fluid supply passage, a drain passage, and a tappet supply passage, wherein the spool valve element is moveable between a fill position, in which the fluid supply passage is fluidly connected with the tappet supply passage, and a drain position, in which the tappet supply passage is fluidly connected with the drain passage.

8. The pumping system of claim 7, wherein a plurality of pushrods extends between the actuator portion and the activation portion.

9. The pumping system of claim 7, wherein, during operation, the actuator portion is connected onto a tank such that the activation portion and the pumping portion extend into an interior of the tank, wherein the pumping portion is arranged to be immersed into the cryogenic fluid contained within the interior of the tank.

10. The pumping system of claim 7, wherein the spool valve supply outlet is fluidly connected with the bore into which the spool valve element is disposed, and wherein presence of the pressurized hydraulic fluid at the spool valve supply outlet pressurizes the bore beneath the spool valve element causing the spool valve element to move from the fill position to the drain position.

11. The pumping system of claim 7, wherein the hydraulic oil supply passage and the fluid supply passage are fluidly connected at all times and arranged to receive the pressurized hydraulic fluid from the hydraulic pump.

12. The pumping system of claim 7, wherein each of the plurality of actuator portions further comprises:

a tappet disposed in a tappet bore, the tappet bore formed in a tappet housing and being fluidly connected with an activation passage formed in the tappet housing, the activation passage being fluidly connected with the tappet supply passage;

wherein the pushrod is disposed in abutting relation with an end of the tappet that is opposite the activation passage; and a return spring disposed to bias the pushrod towards the tappet.

13. The pumping system of claim 7, further comprising a heat exchanger disposed to heat the cryogenic fluid provided by the pump.

* * * * *